United States Patent [19]

Petersen et al.

[11] Patent Number: 4,662,257

[45] Date of Patent: May 5, 1987

[54] COUNTERTOP BREAD SLICER

[75] Inventors: Bernard L. Petersen, Grand Rapids; Gary L. Kruse, Spring Lake, both of Mich.

[73] Assignee: Oliver Products Company, Grand Rapids, Mich.

[21] Appl. No.: 676,943

[22] Filed: Nov. 30, 1984

[51] Int. Cl.[4] ..... B26D 7/06

[52] U.S. Cl. ..... 83/407; 83/425.2; 83/437; 83/751

[58] Field of Search ..... 83/751, 409, 425.2, 83/425.3, 431, 407, 356.2, 356.3, 437

[56] References Cited

U.S. PATENT DOCUMENTS

| | | | |
|---|---|---|---|
| 2,095,620 | 10/1937 | Tuthill et al. | 83/751 |
| 2,143,460 | 1/1939 | Tuthill et al. | 83/751 |
| 2,147,322 | 2/1939 | Tuthill et al. | 83/751 |
| 2,162,138 | 6/1939 | Tuthill et al. | 83/751 |
| 2,170,312 | 8/1939 | Tuthill et al. | 83/751 |
| 2,528,853 | 11/1950 | Brustowsky | 83/751 |
| 2,789,606 | 4/1957 | Solomon | 83/751 |
| 3,245,447 | 4/1966 | Jones | 83/751 X |
| 4,434,692 | 3/1984 | Desert et al. | 83/425.3 X |

FOREIGN PATENT DOCUMENTS

| | | | |
|---|---|---|---|
| 2462976 | 3/1981 | France | 83/751 |

*Primary Examiner*—James M. Meister

*Attorney, Agent, or Firm*—Price, Heneveld, Cooper, DeWitt & Litton

[57] ABSTRACT

A compact and efficient bread slicer for countertop use such as in an in-store bakery or delicatessen. The slicer includes horizontal slicing blades and a bread cradle for carrying a loaf upwardly along a linear path through the blades. An infeed table extends downwardly from the blades to support the bread along the linear path. Preferably, the infeed table and the linear path are inclined from the vertical such that the loaf falls against the table to ride therealong. Further preferably, the cradle movement mechanism includes a gas spring for urging the bread through the blades at a generally uniform speed.

14 Claims, 3 Drawing Figures

COUNTERTOP BREAD SLICER

BACKGROUND OF THE INVENTION

The present invention relates to bread slicers, and more particularly to compact bread slicers suitable for countertop use.

A wide variety of bread slicers has been developed for high-volume commercial applications. However, many small food service operations (e.g. small bakeries, in-store bakeries, and delicatessens) although requiring a bread slicer do not have a need for, nor the resources to purchase, these high-volume slicers. Accordingly, a number of countertop bread slicers have been developed. However, these countertop slicers are not without their drawbacks.

One countertop slicer is illustrated in U.S. Pat. 2,789,606, issued April 23, 1957, to Solomon, and entitled BREAD SLICING MACHINE. This bread slicer includes a horizontal blade assembly and a hydraulically actuated cradle for both clamping a loaf of bread and forcing the loaf upwardly through the blade assembly. The cradle mechanism and associated actuating mechanism are relatively complicated, requiring hydraulics to both clamp the bread between a pair of fingers and also to shift the cradle upwardly through the blade assembly. The hydraulics are relatively complicated, expensive, and bulky. Further, servicing the hydraulic mechanism is relatively difficult.

Another countertop slicer includes a fixed cradle and a manually lifted blade assembly. A loaf is sliced by lifting the blade assembly, placing the loaf in the cradle, and releasing the blade assembly which slices through the loaf. This unit is relatively difficult to operate because the blade assembly is relatively heavy and not easily lifted.

SUMMARY OF THE INVENTION

The aforementioned problems are overcome in the present invention wherein a countertop bread slicer is provided having a compact size and a simplified construction, while still providing the requisite performance. More particularly, the slicer includes a horizontal blade assembly, an infeed table, and a vertically shiftable cradle for carrying a loaf upwardly against the infeed table and through the blade assembly. The infeed table extends downwardly from the blade assembly and is inclined from the vertical. The bread cradle is inclined from the horizontal toward the infeed table such that a loaf of bread supported thereon falls against the infeed table and slides upwardly thereagainst through the blade assembly. Preferably, structure is provided for maintaining the angle of the cradle relatively constant throughout its vertical travel and also for maintaining the proximity of the cradle to the infeed table relatively constant. Consequently, the loaf receives the requisite support and is not twisted during slicing.

In a preferred aspect of the invention, the cradle movement mechanism includes a gas spring to carry the loaf upwardly through the blade assembly at a relatively uniform rate. This relatively simple, yet effective, construction is inexpensive and enhances slicing.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 3:
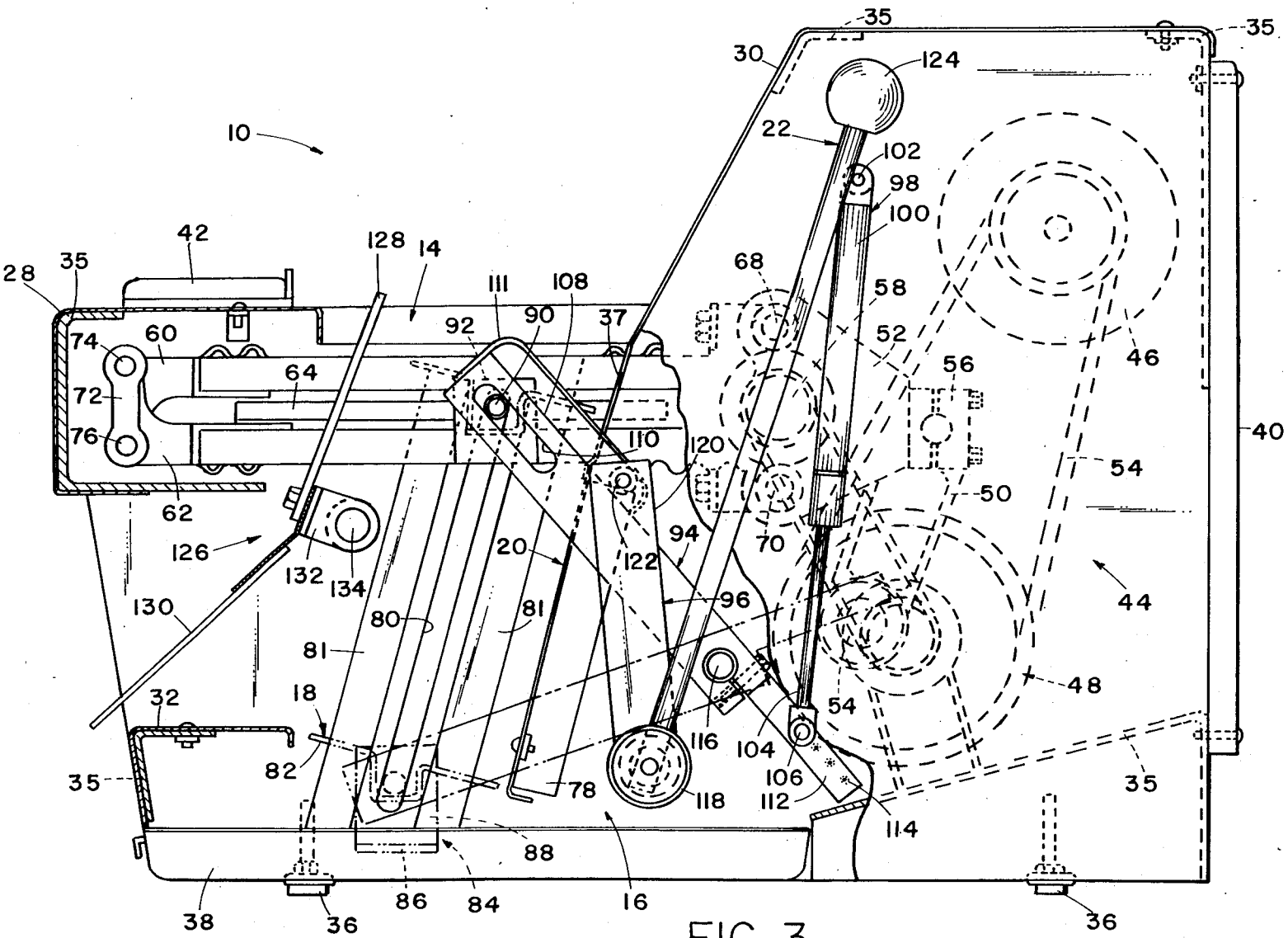
FIG. 3 is a partially sectional side elevational view of the bread slicer.

A bread slicer constructed in accordance with a preferred aspect of the invention is illustrated in the drawings and generally designated 10. The slicer includes housing 12, blade assembly 14, and feed mechanism 16 having cradle 18 and infeed table 20. Handle 22 is operatively connected to cradle 18 as will be described to shift the cradle between an upper position illustrated in FIG. 3 and a lower position illustrated in phantom in FIG. 3. In use, a loaf is sliced by first pulling handle 22 forwardly lowering cradle 18 to its lower position placing a loaf of bread on cradle 18, actuating blade assembly 14, and releasing handle 22 whereupon cradle 18 shifts upwardly to carry the loaf along infeed table 20 and through blade assembly 14 to be cut transversely into slices.

Housing 12 includes rear portion 24 and forward portion 26. Housing 12 further includes front guard 28, top guard 30, infeed plate 32, side guards 34 all secured to slicer frame 35 (see also FIG. 3). Start and stop switches 31 and 33 are mounted in front guard 28. Fingered table lip 37 extends downwardly from top guard 30 to interleave with the slicer blades. A plurality of levelers or feet 36 are also supported within frame 35 enabling the slicer to be leveled on a countertop. Crumb tray 38 is slidably supported within the forward portion of housing 12 under blade assembly 14 and cradle 18 to catch crumbs during slicing. The crumb tray is removable through the forward end of the slicer for easy emptying. Inspection plate 40 is mounted on the back of housing 12 to provide access to the back of the slicer. Bagging scoop 42 is mounted on front guard 28 just forward of blade assembly 14 to facilitate bagging of the sliced loaves in a conventional manner.

Blade assembly 14 and drive mechanism 44 (FIG. 3) are generally well-known to those having ordinary skill in the art and have long been sold by Oliver Products Company, the assignee of the present invention, for example in its Model No. 777 bread slicer. Generally speaking, drive 44 includes motor 46, pulley 48, rod 50, and rocker 52. Belt 54 interconnects motor 46 and pulley 48 to drive the pulley. Rod 50 is eccentrically mounted at one end to pulley 48 on stud 54 and is pivotally mounted at its opposite end to rocker 52 within block 56. Rocker 52 is pivotally supported on shaft 58 and oscillates thereabout when driven by rod 50 rotating eccentrically about pulley 48.

Blade assembly 14 (FIG. 3) includes upper blade frame 60 and lower blade frame 62 each supporting a plurality of knives or blades 64, respectively. Frames 60 and 62 are each pivotally secured at one end to rocker 52 on shafts 68 and 70, respectively, to oscillate with oscillation of the rocker. Frames 60 and 62 are each supported at their forward ends on frame links 72 (only one shown). The link illustrated is pivotally secured about pin 74 to lower blade frame 62 and about lower pin 76 to slicer frame 35. Consequently, frames 60 and 62 oscillate in opposite directions as driven by drive mechanism 44.

Infeed table 20 is mounted on mounting angles 78 secured to slicer frame 35. Infeed table 20 is generally coplanar with table lip 37 to define a generally continuous feeding ramp. Both table 20 and lip 37 are inclined from the vertical to support a loaf throughout the vertical travel as cradle 18 is shifted between the lower position and upper position.

Slicer frame 35 defines slots 80 generally parallel to table 20 at each side of the slicer. A pair of spaced, generally parallel guide bars 81 flank slot 80 and are fixedly secured to frame 35. Cradle 18 includes fingered platform 82 which directly supports the loaf and interleaves with blades 64 when in the upper position. Platform 82 is supported on bracket 84 which is generally U-shaped including horizontal floor 86 and a pair of sidewalls 88 extending upwardly therefrom at the opposite ends thereof. Each of sidewalls 88 in turn supports a pin 90 which rides within one of slots 80. Slide block 92 is fixedly secured to each of bracket sidewalls 88 to ride between guide bars 81 to define the linear travel path of cradle 18 and to insure that the inclination of platform 82 from the horizontal remains relatively constant throughout its vertical travel. Platform 82 is inclined from the horizontal toward table 20 and most preferably is generally perpendicular thereto. Consequently, a loaf supported on platform 82 will rest against table 20 and ride thereagainst as the loaf is forced upwardly through blade assembly 14.

The cradle transportation mechanism includes cradle arm 94, actuator arm 96, handle 22, and gas spring 98. Gas spring 98 is generally well-known to those having ordinary skill in the gas spring art and in the preferred embodiment is the spring sold as Model No. FK-11-Pl@60# by Gas Spring Corp. The spring includes cylinder 100 pivotally secured to the slicer frame about pin 102 and rod 104 pivotally secured to cradle arm 94 about pin 106.

Cradle arm 94 includes first end 108 defining a longitudinal slot 110 which receives cradle pin 90. C-shaped keeper 111 is secured to the upper edge of end 108. Opposite end 112 of the cradle arm defines a plurality of apertures 114 for receiving pin 106 to connect the gas spring thereto. Cradle arm 94 is pivotally mounted to the slicer frame between its opposite ends on shaft 116. Consequently, the force supplied by gas spring 98 urges lever end 112 downwardly and consequently lever end 108 upwardly to urge cradle 18 to its upper position. Slot 110 slides along pin 90 as cradle 18 is transported along its generally vertical path. Consequently, pins 90 transmit force from cradle arm 94 to cradle 18.

Actuator arm 96 includes first end 118 pivotally supported in slicer frame 35 and opposite end 120 supporting roller 122 which rides along the upper surface of carriage arm 94. Lever keeper 111 maintains roller 122 on the proper portion of lever arm 94. Actuator arm 118 includes a socket which receives handle 22 such that pivoting of handle 22 results in pivoting of arm 96. Knob 124 is mounted on the upper end of handle 22 to provide a convenient grasping portion for the machine operator.

Figure 1:
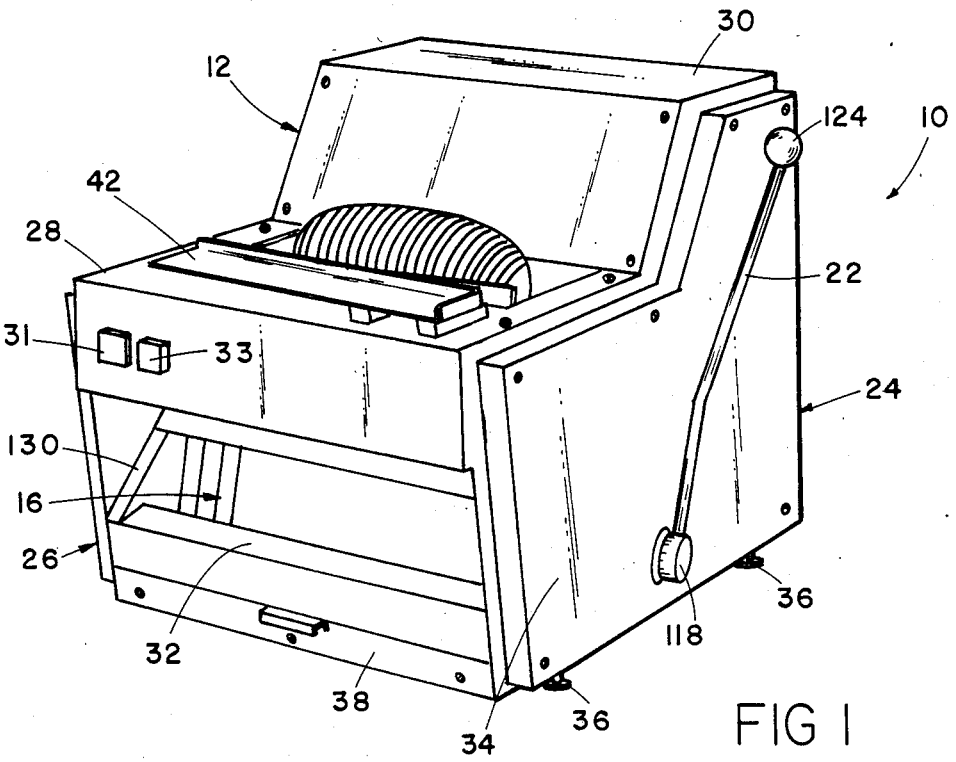
FIG. 1 is a perspective view of the countertop bread slicer of the present invention showing a loaf having just been sliced.

Knife guide assembly 126 is pivotally supported between the opposite sides of slicer frame 35. Assembly 126 includes fingered knife guide 128 extending upwardly through knives 64 and lever 130 (see also FIG. 1) fixedly secured at an angle thereto. Knife guide 128 is pivotally supported on lugs 132 about pins 134 on the slicer frame. A torsion spring (not shown) is mounted on pins 134 to bias guide assembly 126 in a clockwise position as viewed in FIG. 3. Knife guide 128 is therefore biased toward table 20 to urge a loaf thereagainst. An arm (not shown) extends from one of lugs 132 to engage cradle bracket 84 to pivot the assembly 126 in response to movement of cradle 18. The knife guide maintains the knives 64 in proper spaced relation to insure evenness of the slices and to insure that cradle 18 can pass upwardly therethrough.

Operation

Figure 2:
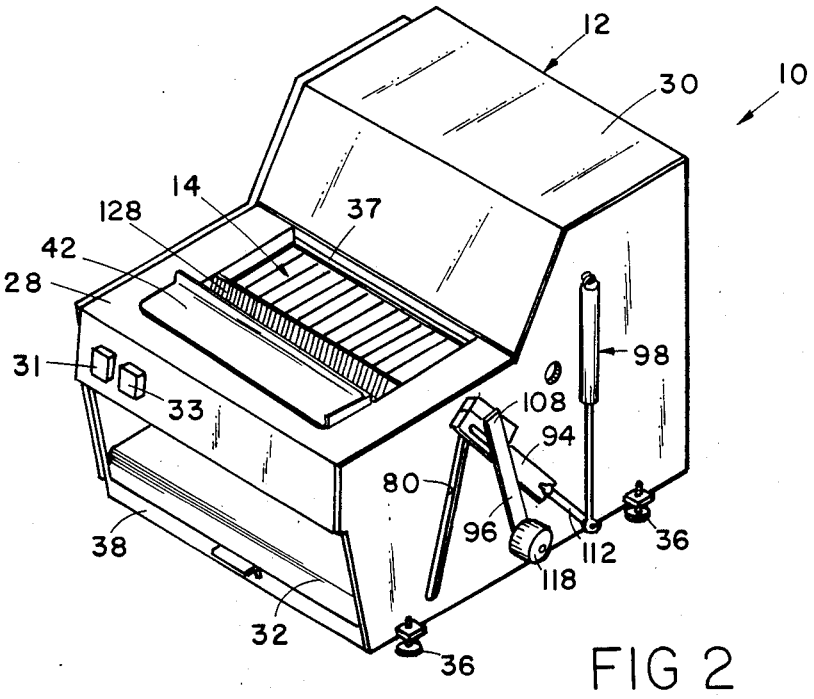
FIG. 2 is a perspective view of the bread slicer with the right housing cover removed.

Countertop slicer 10 easily, effectively, and precisely slices loaves of bread. Slicer 10 is operated by a person standing in front of the slicer (i.e., to the left of FIG. 3 or the left and slightly forward of FIGS. 1 and 2). Handle 22 and more particularly knob 124 is grasped and pulled forwardly. As handle 22 is rotated, arm 96 also rotates such that roller 122 rides along arm 94 to push arm 94 downwardly. Resistance from gas spring 98 will be felt as platform 18 is lowered to the position shown in phantom in FIG. 3 wherein its leading edge is generally aligned with infeed plate 32. As arm 94 is pivoted, gas spring 98 is compressed such that there is spring force urging cradle 18 upwardly. Guide assembly 126 also pivots clockwise as viewed in FIG. 3 until lever 130 abuts front guard 28. While the operator holds handle 22 in its fully forward position, a loaf to be sliced is grasped with the operator's left hand and inserted between front guard 28 and infeed table 32 to be positioned on platform 82 against infeed table 20. Still holding handle 22 in its forward position, the operator pushes start button 31 with his left hand which actuates motor 46 causing blades 64 to oscillate. A limitswitch (not shown) insures that motor 46 cannot be actuated unless handle 22 is fully forward and switch 31 is depressed. The operator then slowly releases handle 22 until the loaf initially engages blades 64 as viewed through blade assembly 14. At this time, handle 22 is released, and cradle 18 is urged upwardly under a relatively uniform force at a relatively uniform rate under the control of gas spring 98 to force the loaf through the blade assembly. The loaf, as it is carried upwardly on cradle 18, engages the spring-loaded knife guide 128 which holds the loaf against the table. As the cradle 18 moves to the upper position, the knife guide 128 is pushed in a counterclockwise direction as viewed in FIG. 3 by the loaf and/or the arm (not shown) engaging the cradle bracket 84. Arm 94 trips a limitswitch (not shown) when in the upper position to turn off motor 46 and thereby stop blades 64. This sliced loaf is then removed from blade assembly 14 and positioned on bagging scoop 42 to bag the loaf in conventional fashion.

Slicing can be immediately stopped at any time by depressing stop switch 33.

The force, and incidentally the speed, at which cradle 18 is shifted upwardly under the influence of gas spring 98 can be partially adjusted by mounting pin 106 in a different one of apertures 114 in lever arm end 112. Moving pin 106 further away from pin 116 results in cradle 18 moving with greater force and more quickly. Conversely, moving pin 106 toward pin 116 causes the cradle to move with lesser force and more slowly.

Crumb tray 38 is removed periodically as necessary to empty crumbs which fall thereinto.

The above description is that of a preferred embodiment of the invention. Various changes and alterations can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. a bread slicer comprising:

a generally horizontal blade assembly;

a bread cradle means for supporting a loaf of bread and being generally vertically shiftable between a lower poisition below said blade assembly permitting a loaf to be positioned on said cradle means and an upper position generally proximate said blade assembly; and urging means for urging said cradle means toward the upper position, said urging means including a gas spring to transport said cradle at a generally uniform speed;

whereby a loaf can be sliced by lowering said cradle means, positioning a loaf thereon, and releasing said cradle means to carry the loaf at a generally uniform speed through the blade assembly.

2. A bread slicer as defined in claim 1 wherein said urging means further includes a first lever having a first end operatively connected to said cradle means and a second end connected to said gas spring.

3. A bread slicer as defined in claim 2, wherein said urging means further includes a second lever having a first end operatively connected to said first lever first end, whereby pivotal movement of said second lever operatively moves said cradle toward said lower position.

4. A bread slicer as defined in claim 1 further comprising a generally vertical infeed table extending downwardly from said horizontal blade assembly; and wherein said bread cradle is generally vertically shiftable along a path proximate the infeed table; and further wherein said cradle includes retaining means for maintaining a loaf against said infeed table throughout the travel path of said cradle, whereby the loaf is carried along said infeed table during slicing.

5. A bread slicer as defined in claim 4 wherein said infeed table is inclined from the vertical.

6. A bread slicer as defined in claim 5 wherein said retaining means includes means for supporting said cradle means generally perpendicularly to said infeed table throughout the travel of said cradle means.

7. A bread slicer as defined in claim 6 wherein said retaining means further includes means for maintaining a generally uniform spacing between said cradle means and said infeed table throughout the travel of said cradle means.

8. A bread slicer comprising:

a housing having a forward portion, a rear portion, and at least one side;

generally horizontal blade means for slicing loaves of bread, said blade means being mounted in said forward portion of said housing to be accessible from above said housing;

motive means for driving said blade means, said motive means being located within said rear portion of said housing and thus behind said blade means;

a bread cradle in said forward portion of said housing, said cradle being vertically shiftable between a lower position below said blade means and an upper position proximate said blade means; and lever means for vertically shifting said cradle along a generally linear path, said lever means including a manually oprated handle mounted on said side of said housing, said lever means further including bias means for biasing said cradle to said upper position, said bias means including a gas spring to shift the loaf upwardly at a generally unifrom rate when said manually operated handle is released.

9. A bread slicer as defined in claim 8 wherein said lever means futher includes a cradle lever having a first end operatively connected to said bread cradle and a second end operatively connected to said gas spring, said cradle lever being pivotally supported between said first and second ends.

10. A bread slicer as defined in claim 9 wherein said lever means further comprises an actuating lever having a first end coupled to said cradle lever first end and a second end coupled to said manually operated lever,

11. A bread slicer as defined in claim 8 further comprising infeed table means extending downwardly from said blade means for supporting and guiding a loaf supported on said cradle between the lower and upper positions, said infeed table means being inclined from the vertical.

12. A bread slicer as defined in claim 11 further comprising means for causing a loaf to engage and ride against said infeed table means as said bread cradle travels along said linear path. whereby actuating of said manually actuated lever actuates said bread cradle.

13. A bread slicer as defined in claim 13 wherein said causing means comprises means for maintaining said cradle generally perpendicular to said infeed table means as said cradle travels along said linear path.

14. A bread slicer as defined in claim 13 wherein said causing means further comprises means for maintaining a relatively uniform distance between said cradle and said infeed table as said cradle travels along said linear path.

* * * * *

UNITED STATES PATENT AND TRADEMARK OFFICE

CERTIFICATE OF CORRECTION

PATENT NO. : 4,662,257

DATED : May 5, 1987

INVENTOR(S) : Bernard L. Petersen

It is certified that error appears in the above-identified patent and that said Letters Patent is hereby corrected as shown below:

Column 6, claim 8, line 17:

"oprated" should be --operated--

Column 6, claim 10, lines 33 and 34:

After "operated lever," insert --whereby actuating of said manually actuated lever actuates said bread cradle.--

Column 6, claim 12, lines 43 and 44:

After "path." delete "whereby actuating of said manually actuated lever actuates said bread cradle."

Column 6, claim 13, line 45:

"claim 13" should be --claim 12--

Signed and Sealed this

Thirteenth Day of October, 1987

*Attest:*

*Attesting Officer*

DONALD J. QUIGG

*Commissioner of Patents and Trademarks*